US006089072A

United States Patent [19]

Fields

[11] Patent Number: 6,089,072

[45] Date of Patent: Jul. 18, 2000

[54] METHOD AND APPARATUS FOR FORMING A CAN END HAVING AN IMPROVED ANTI-PEAKING BEAD

[75] Inventor: Brian Fields, Hinsdale, Ill.

[73] Assignee: Crown Cork & Seal Technologies Corporation, Alsip, Ill.

[21] Appl. No.: 09/137,436

[22] Filed: Aug. 20, 1998

[51] Int. Cl.[7] ..... B21D 51/44

[52] U.S. Cl. ..... 72/379.4; 72/348

[58] Field of Search ..... 72/348, 379.4

[56] References Cited

U.S. PATENT DOCUMENTS

| | | | |
|---|---|---|---|
| 2,700,355 | 1/1955 | Erb | 113/120 |
| 3,417,898 | 12/1968 | Bozek et al. | 220/66 |
| 3,537,291 | 11/1970 | Hawkins | 72/336 |
| 3,650,387 | 3/1972 | Honrsby et al. | 206/46 F |
| 3,957,005 | 5/1976 | Heffner | 113/1 F |
| 4,031,837 | 6/1977 | Jordan | 113/121 C |
| 4,093,102 | 6/1978 | Kraska | 220/67 |
| 4,102,467 | 7/1978 | Woodley | 220/67 |
| 4,109,599 | 8/1978 | Schultz | 113/121 C |
| 4,217,843 | 8/1980 | Kraska | 113/121 C |
| 4,308,970 | 1/1982 | Von Holdt | 220/306 |
| 4,365,724 | 12/1982 | Walden | 220/67 |
| 4,434,641 | 3/1984 | Nguyen | 72/354 |
| 4,516,420 | 5/1985 | Bulso, Jr. et al. | 72/329 |
| 4,524,879 | 6/1985 | Fundom et al. | 220/273 |
| 4,538,758 | 9/1985 | Griffith | 229/4.5 |
| 4,549,424 | 10/1985 | Bulso, Jr. et al. | 72/329 |
| 4,559,801 | 12/1985 | Smith et al. | 72/348 |
| 4,567,746 | 2/1986 | Bachmann et al. | 72/348 |
| 4,571,978 | 2/1986 | Taube et al. | 72/349 |
| 4,574,608 | 3/1986 | Bulso, Jr. et al. | 72/348 |
| 4,577,774 | 3/1986 | Nguyen | 220/66 |
| 4,578,007 | 3/1986 | Diekhoff | 413/6 |
| 4,587,825 | 5/1986 | Buslo, Jr. et al. | 72/329 |
| 4,587,826 | 5/1986 | Buslo, Jr. et al. | 72/329 |
| 4,606,472 | 8/1986 | Taube et al. | 220/66 |
| 4,626,158 | 12/1986 | Le Bret | 413/6 |
| 4,641,761 | 2/1987 | Smith et al. | 220/66 |
| 4,697,972 | 10/1987 | Le Bret et al. | 413/6 |
| 4,713,958 | 12/1987 | Bulso, Jr. et al. | 72/348 |
| 4,715,208 | 12/1987 | Bulso, Jr. et al. | 72/348 |
| 4,716,755 | 1/1988 | Buslo, Jr. et al. | 72/349 |
| 4,722,215 | 2/1988 | Taube et al. | 72/349 |
| 4,735,863 | 4/1988 | Bachmann et al. | 428/579 |

(List continued on next page.)

FOREIGN PATENT DOCUMENTS

| | | | |
|---|---|---|---|
| 0 139 282 A2 | 5/1985 | European Pat. Off. . | |
| 0 177 426 A1 | 4/1986 | European Pat. Off. . | |
| 92 11 788 | 2/1993 | Germany . | |
| 2-192837 | 7/1990 | Japan | 72/379.4 |
| 2 067 159 | 7/1981 | United Kingdom . | |
| 2 288 759 | 11/1995 | United Kingdom . | |
| WO 96/37414 | 11/1996 | WIPO . | |

OTHER PUBLICATIONS

Moran, P., "Double Seam Formation", *Beverage Can 'Mini Seam'Double Seam Manual*, published at least as early as Apr. 1, 1995, pp. 7–8.

*Primary Examiner*—Lowell A. Larson
*Attorney, Agent, or Firm*—Woodcock Washburn Kurtz Mackiewicz & Norris LLP

[57] ABSTRACT

An apparatus and method for forming a narrow, tightly radiused annular anti-peaking bead in a can end in a multi-station conversion press. In a first forming station, a metal blank is first drawn into a cup shaped blank having a side panel and then reformed by reversing the action of the drawing tooling so as to fold the side panel into an initial, relatively broad annular bead. The initially beaded can end is then transferred to a second forming station where its periphery is pre-curled and the annular bead is reworked so as to reduce its width and radii of curvature. The reworking of the bead is performed by free drawing a tool over the inner wall of the bead without drawing or bending the interior surface of the bead around a tool so as to avoid cracking or excessive thinning of the metal. The seaming panel of the can end is firmly clamped during the reworking to maintain control over the location of the bead. The can end having the reworked bead is then transferred to a third forming station for final curling of the seaming panel.

33 Claims, 14 Drawing Sheets

U.S. PATENT DOCUMENTS

| | | | |
|---|---|---|---|
| 4,784,282 | 11/1988 | Le Bret et al. | 220/67 |
| 4,808,052 | 2/1989 | Buslo, Jr. et al. | 413/8 |
| 4,809,861 | 3/1989 | Wilsinson et al. | 220/66 |
| 4,823,973 | 4/1989 | Jewitt et al. | 220/67 |
| 4,865,506 | 9/1989 | Kaminski | 413/56 |
| 4,903,521 | 2/1990 | Bulso, Jr. et al. | 72/336 |
| 4,932,554 | 6/1990 | Smith et al. | 220/319 |
| 4,934,168 | 6/1990 | Osmanski et al. | 72/348 |
| 4,955,223 | 9/1990 | Stodd et al. | 72/336 |
| 4,977,772 | 12/1990 | Bulso, Jr. et al. | 72/336 |
| 4,991,735 | 2/1991 | Biondich | 220/600 |
| 5,016,785 | 5/1991 | Greenebaum, II | 222/402.1 |
| 5,046,637 | 9/1991 | Kysh | 220/610 |
| 5,069,356 | 12/1991 | Zysset | 220/276 |
| 5,071,302 | 12/1991 | Wahler | 413/31 |
| 5,115,938 | 5/1992 | Thompson | 220/618 |
| 5,149,238 | 9/1992 | McEldowney et al. | 413/8 |
| 5,221,183 | 6/1993 | Hoeffken | 415/215.1 |
| 5,346,087 | 9/1994 | Klein | 220/268 |
| 5,356,256 | 10/1994 | Turner et al. | 413/8 |
| 5,460,286 | 10/1995 | Rush et al. | 220/306 |
| 5,582,319 | 12/1996 | Heyes et al. | 220/454 |
| 5,595,322 | 1/1997 | Kramer | 220/619 |
| 5,685,189 | 11/1997 | Nguyen et al. | 72/348 |

METHOD AND APPARATUS FOR FORMING A CAN END HAVING AN IMPROVED ANTI-PEAKING BEAD

FIELD OF THE INVENTION

The current invention is directed to a method and apparatus for making ends for cans, such as two piece cans. More specifically, the current invention is directed to the forming of an annular anti-peaking bead in a can end.

BACKGROUND OF THE INVENTION

Metal cans, such as those used to package soft drinks and beer, have at least one end that is separately manufactured and attached to the remainder of the can body. In a two-piece can, the body of the can is drawn and ironed so as to integrally form sidewalls and a bottom. A separate can end is manufactured by forming a side wall, referred to as the "chuck wall," and a curled seaming panel into a metal blank. The seaming panel is then attached to the can body sidewall by a seaming operation. Because of the internal pressure within the can, the can end must have a high degree of stiffness in order to avoid undergoing excessive deformation. However, in order to achieve economical production, it is important that the metal be as thin as possible. Consequently, can makers strive to reduce the thickness of the can end without sacrificing strength.

In the past, it was found that the stiffness of the can end could be increased by "re-forming" the metal blank so as to include an annular countersink or anti-peaking bead. The bead is formed by inner and outer conical walls connected by a circular arcuate section. Initially, such annular beads were formed by placing the metal blank between upper and lower dies and essentially coining or stamping the bead into the metal. Such a method is disclosed, for example, in U.S. Pat. No. 3,537,291 (Hawkins), assigned to Reynolds Metals Company, U.S. Pat. No. 3,957,005 (Heffner), assigned to Aluminum Company of America, U.S. Pat. No. 4,217,843 (Kraska), assigned to National Can Corporation, and U.S. Pat. Nos. 4,865,506 (Kaminski) and 5,149,238 (McEldowney), assigned to Stolle Corporation, the disclosures of each of which is hereby incorporated by reference in its entirety. However, unless the radius of curvature of the arcuate section was fairly large, forcing the metal into a precisely pre-determined shape, as occurs in such stamping or coining methods, leads to cracking of the metal.

Various approaches have been tried in an effort to overcome the drawbacks of the stamping/coining method. In one approach, an annular bead is formed by drawing the metal around a tool having a radiused support surface, such as an annular nose formed in the periphery of a punch. This approach is disclosed in U.S. Pat. No. 4,574,608 (Bulso), assigned to Redicon Corporation, and U.S. Pat. No. 4,735,863 (Bachmann), assigned to Dayton Reliable Tool Corporation, the disclosure of each of which is hereby incorporated by reference in its entirety. However, particularly when the radius of curvature of the arcuate section is small, this method results in excessive thinning of the metal in the arcuate section—that is, at the crown of the bead. Another approach involved initially drawing a can end blank and then reversing the direction of travel of the tooling so as to essentially fold a portion of the chuck wall back on itself, thereby forming an annular bead. This approach is disclosed in U.S. Pat. No. 4,109,599 (Schultz), assigned to Aluminum Company of America, U.S. Pat. No. 4,722,215 (Taube), assigned to Metal Box, plc, U.S. Pat. No. 4,808,052 (Bulso), assigned to Redicon Corporation, and U.S. Pat. No. 4,934,168 (Osmanski), assigned to Continental Can Company, the disclosure of each of which is hereby incorporated by reference in its entirety. However, the narrowness of the bead and the tightness of the radius of curvature of the arcuate section that could be obtained using this method was limited.

More recently, efforts have been made to improve the bead by initially fully forming a bead in a first operation and then reworking the bead in a second operation to reduce its the width and radius of curvature. Once such approach reworks the bead by stamping it between a punch and a die, such as disclosed in U.S. Pat. No. 4,031,837 (Jordan), assigned to Aluminum Company of America, and U.S. Pat. No. 5,685,189 (Nguyen), assigned to Ball Corporation. However, forcing the metal into a predetermined shape in this manner often results in cracking, as previously discussed. In another approached, the bead is reworked by drawing metal around a tool having a small radiused support surface. This approach is disclosed in U.S. Pat. No. 4,559,801 (Smith), assigned to Ball Corporation, and U.S. Pat. No. 5,356,256 (Turner). However, drawing the metal tightly around a tool can result in excessive thinning, which weakens the bead and defeats the purpose of the reworking operation. Still another approach, disclosed in U.S. Pat. No. 4,991,735 (Biondich), assigned to Aluminum Company of America, involves buckling the bead. However, such buckling is inherently unpredictable and, therefore, difficult to control.

Moreover, in many proposed methods for reworking the bead, such as that disclosed in U.S. Pat. No. 4,031,837 (Jordan), discussed above, neither the chuck wall nor seaming panel is constrained during the reworking. This results in loss of dimensional control over the precise location of the bead. Also, although it has been proposed to reduce the width of the bead in the same station in which the bead is initially formed—see, for example, U.S. Pat. No. 4,715,208 (Bulso), assigned to Redicon Corporation, and U.S. Pat. No. 5,046,637 (Kysh), assigned to CMB Foodcan, plc—such an approach imposes limitations on the tooling that may be used to effect the reworking and requires complex tooling design with respect to the number of moving parts.

Consequently, it would be desirable to provide a method and apparatus for reducing the width and/or radius of curvature of an annular bead in a can end that did not result in cracking or excessive thinning of the metal and that was able to maintain close control of the location of the bead.

SUMMARY OF THE INVENTION

It is an object of the current invention to provide a method and apparatus for reducing the width and/or radius of curvature of an annular bead in a can end that does not result in cracking or excessive thinning of the metal and that is able to maintain close control of the location of the bead. This and other objects is accomplished in a method of forming a can end comprising the steps of (i) forming a metal blank having a periphery and a center panel, (ii) forming an annular bead in the metal blank at a first forming station, the annular bead defined by radially displaced and circumferentially extending inner and outer walls joined by an arcuate section, the inner and outer walls defining a width of the bead therebetween, the annular bead having an exterior surface and an interior surface, the exterior and interior surfaces defining therebetween a thickness of the metal forming the bead, (iii) transferring the metal blank having the annular bead formed in step (ii) to a second forming station, (iv) clamping a portion of metal blank disposed between the periphery and the annular bead at the second forming station, and (v) reducing the width of the annular bead at the second forming station by drawing a tool across at least a portion of the exterior surface of the bead without drawing the interior surface of the bead around a tool surface, thereby free drawing the bead, the free drawing of the bead being performed while simultaneously the clamping of the portion of the metal blank.

The invention also encompasses a multistage press for forming a can end comprising (i) means for forming a metal blank having a periphery and a center panel, (ii) a first forming station comprising means for forming an annular bead in the metal blank, the annular bead defined by radially displaced and circumferentially extending inner and outer walls joined by an arcuate section, the inner and outer walls defining a width of the bead therebetween, the annular bead having an exterior surface and an interior surface, the exterior and interior surfaces defining therebetween a thickness of the metal forming the bead, and (iii) a second forming station. The second forming station comprises (i) means for clamping a portion of the metal blank between the periphery and the annular bead, and (ii) means for reducing the width of the annular bead while simultaneously clamping the portion of the metal blank. The width reducing means comprises (i) a tool having a forming surface thereon, and (ii) means for drawing the tool forming surface across at least a portion of the exterior surface of the bead without drawing the interior surface of the bead around a tool surface.

DESCRIPTION OF THE PREFERRED EMBODIMENT

Figure 1A:
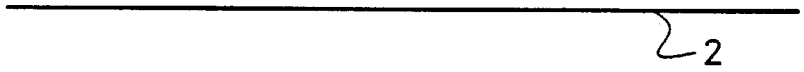
FIGS. 1(*a*) through (*g*) show the successive changes in the geometry of a can end made according to the current invention as it undergoes the various forming steps of the method.
Figure 1B:
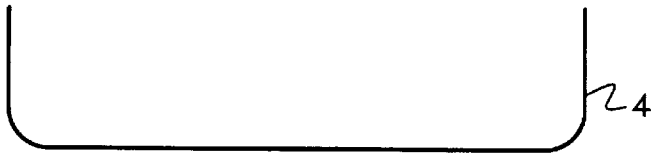
Figure 1C:
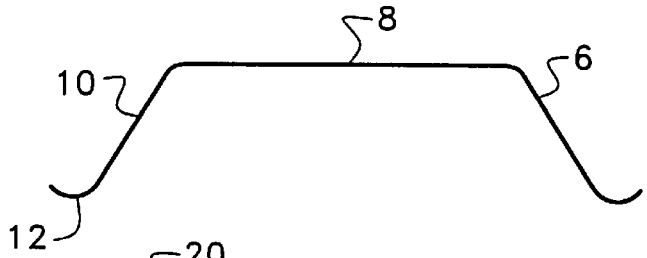
Figure 1D:
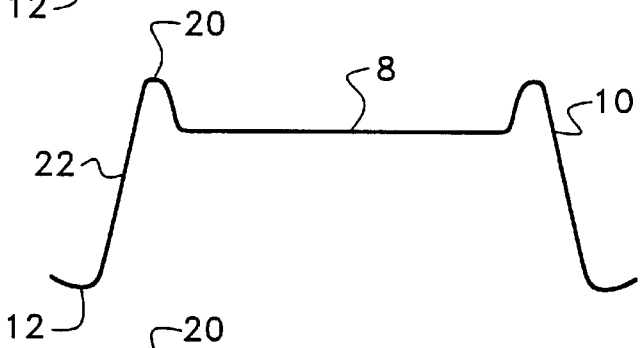
Figure 1E:
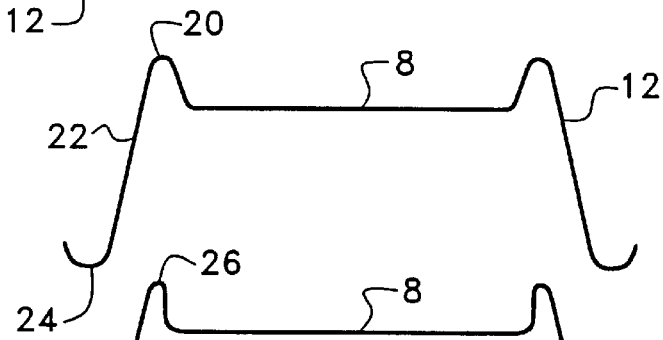
Figure 1F:
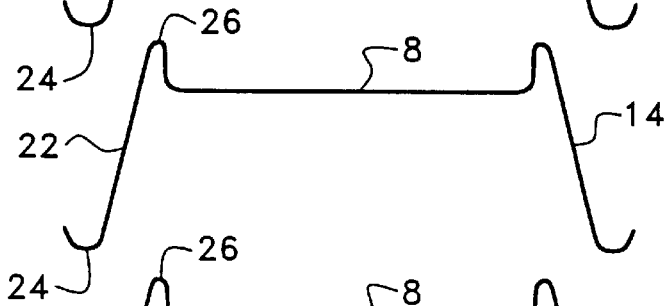
Figure 1G:
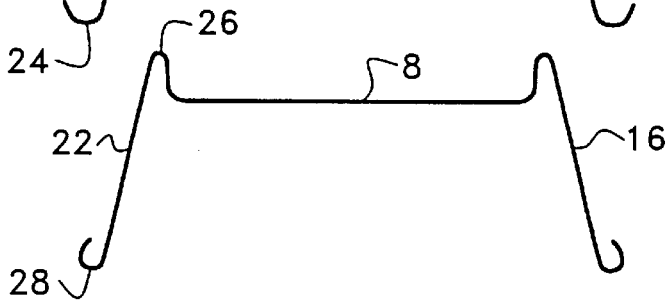
Figure 2A:
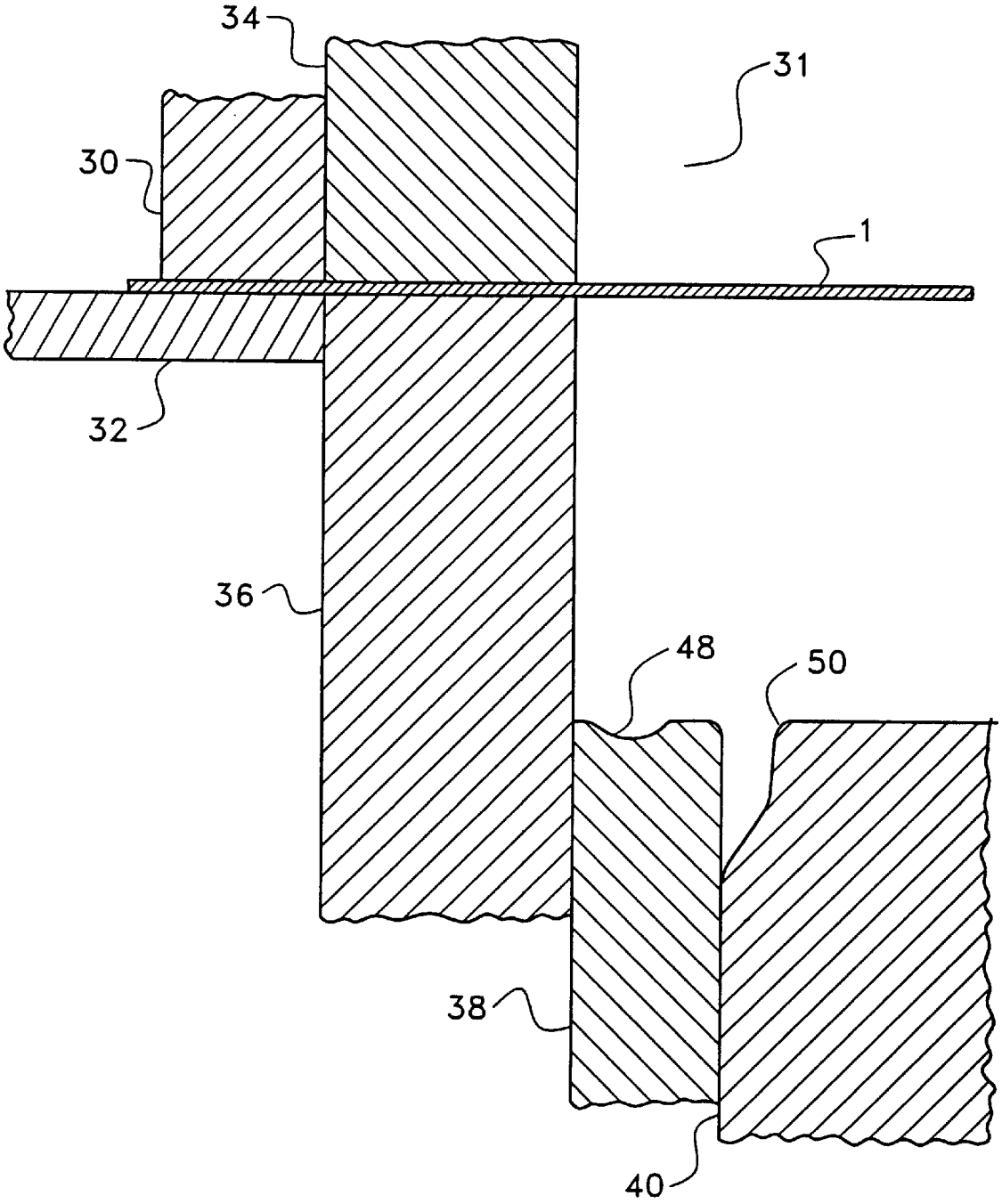
FIG. 2(a) PRIOR ART
FIGS. 2(*a*) through (*e*) show the steps associated with initially forming a can end having a relatively broad annular bead, according to the prior art, in a first forming station.
Figure 2B:
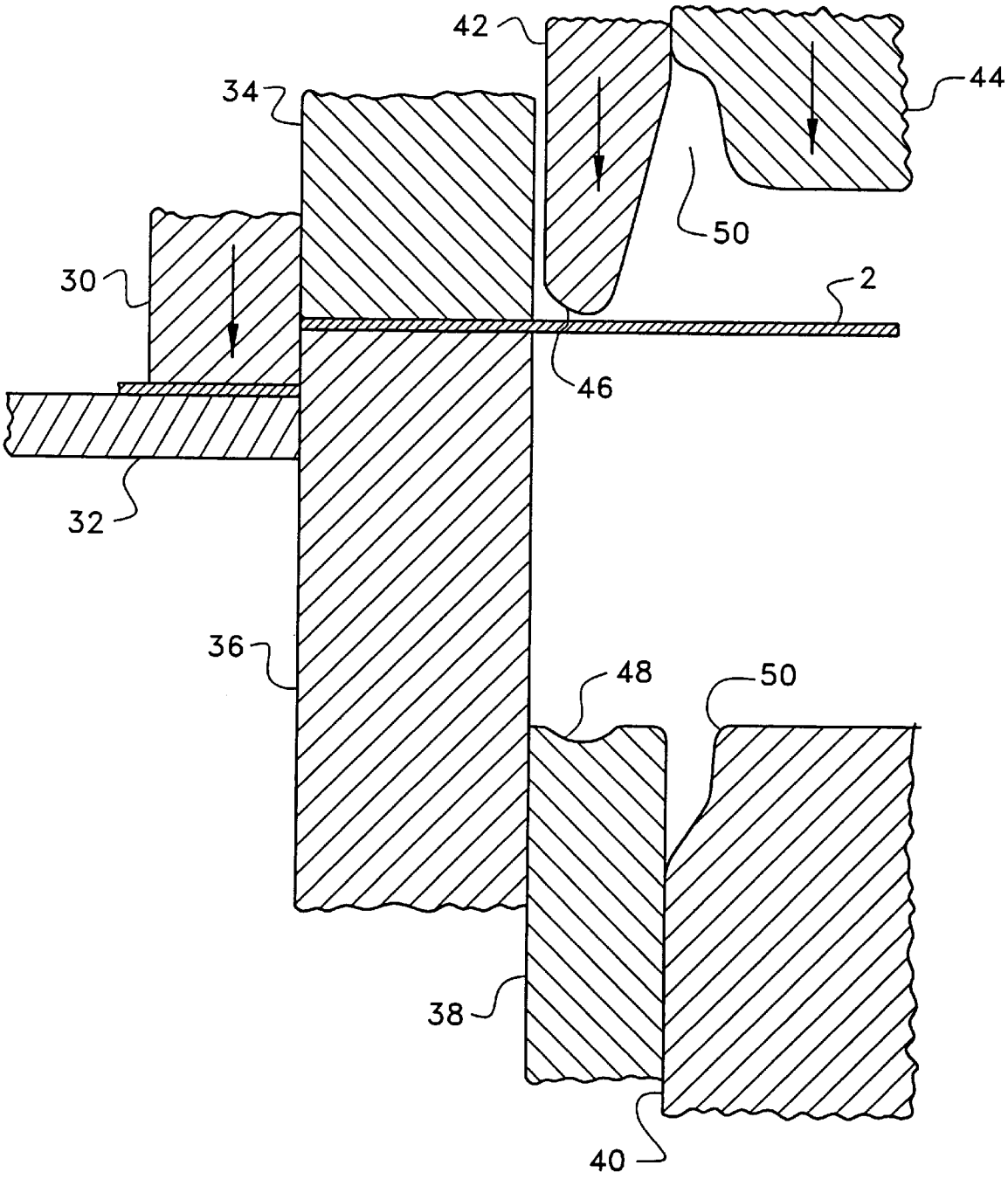
FIG. 2(b) PRIOR ART
Figure 2C:
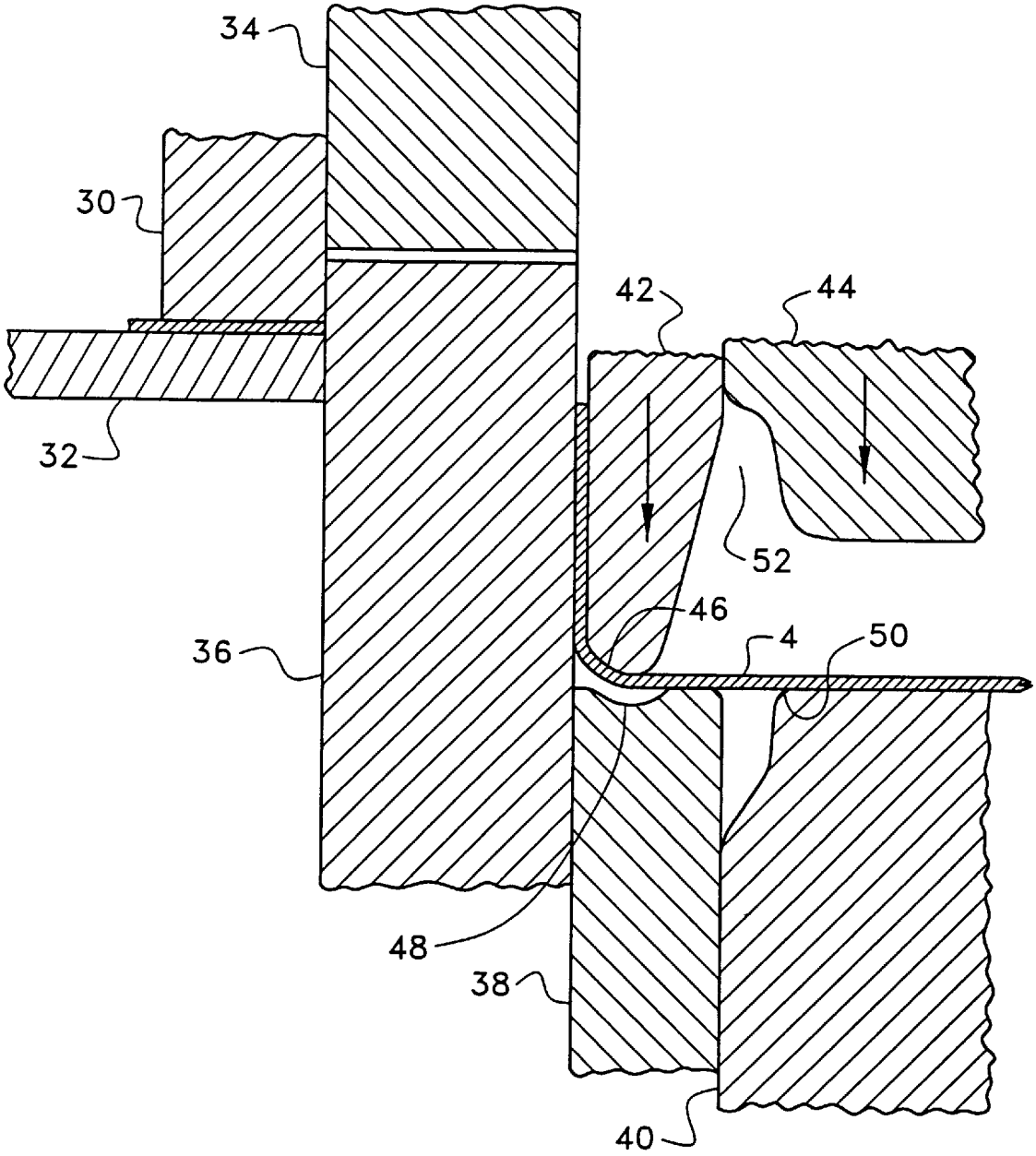
FIG. 2(c) PRIOR ART
Figure 2D:
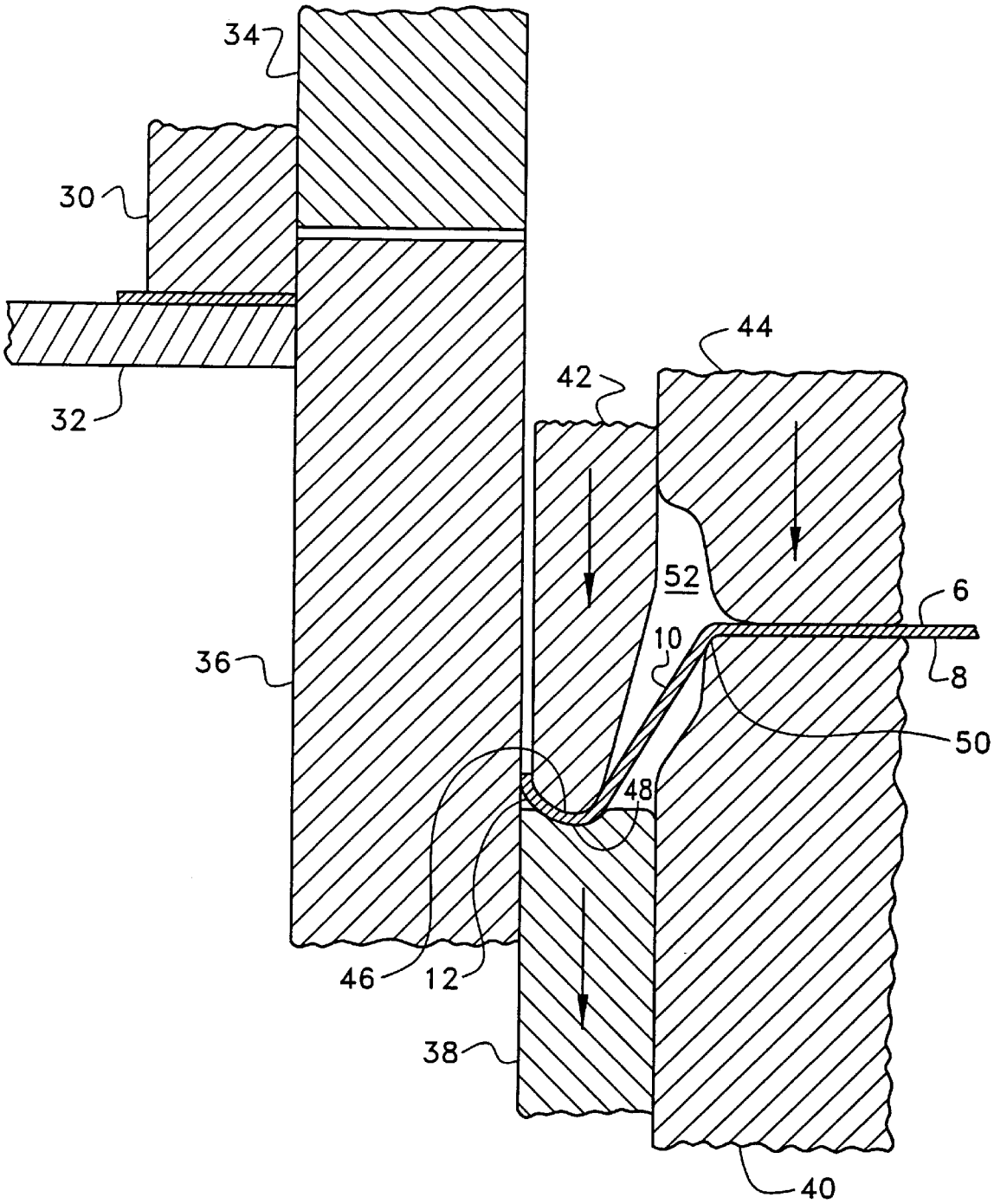
FIG. 2(d) PRIOR ART
Figure 2E:
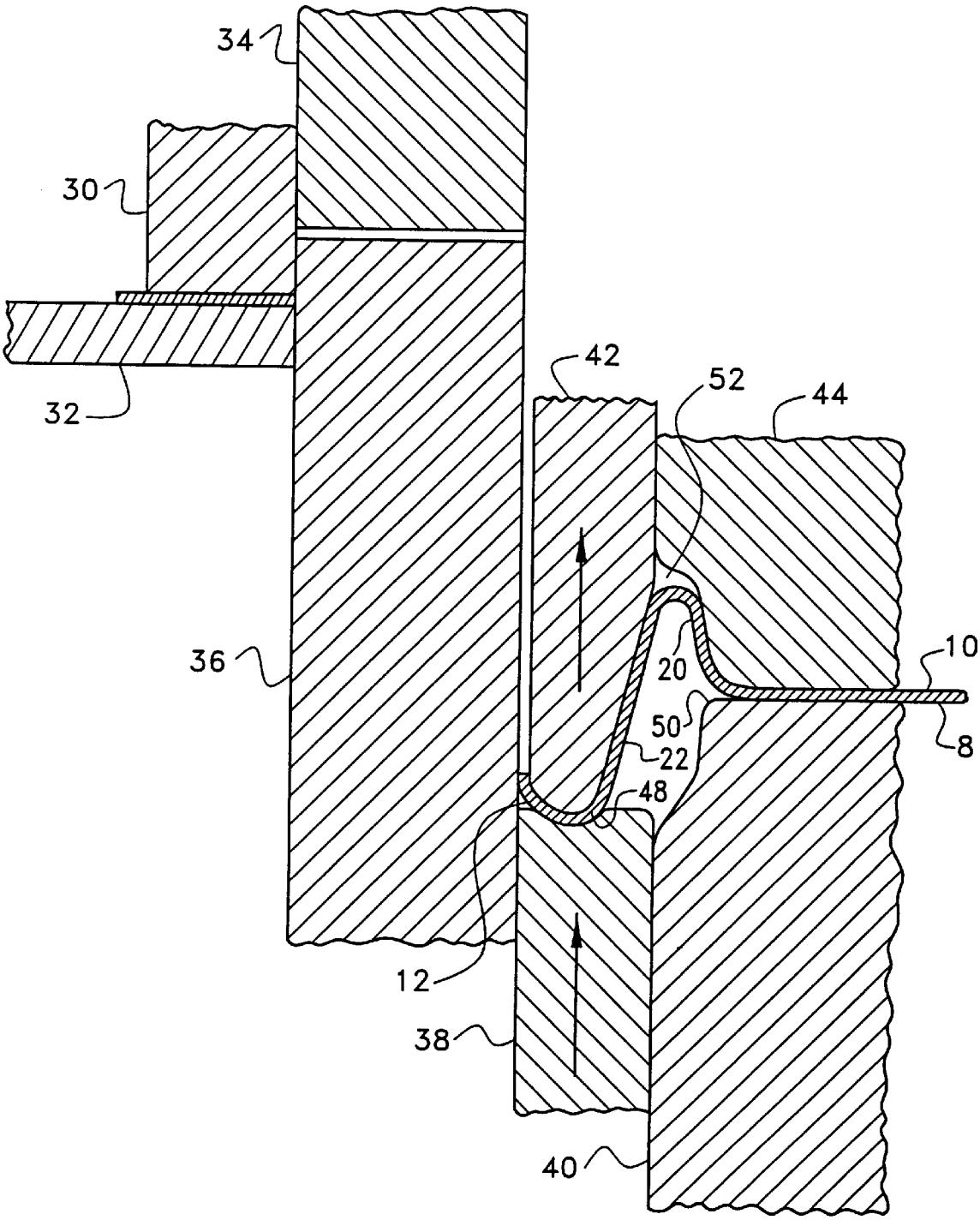
FIG. 2(e) PRIOR ART
Figure 3A:
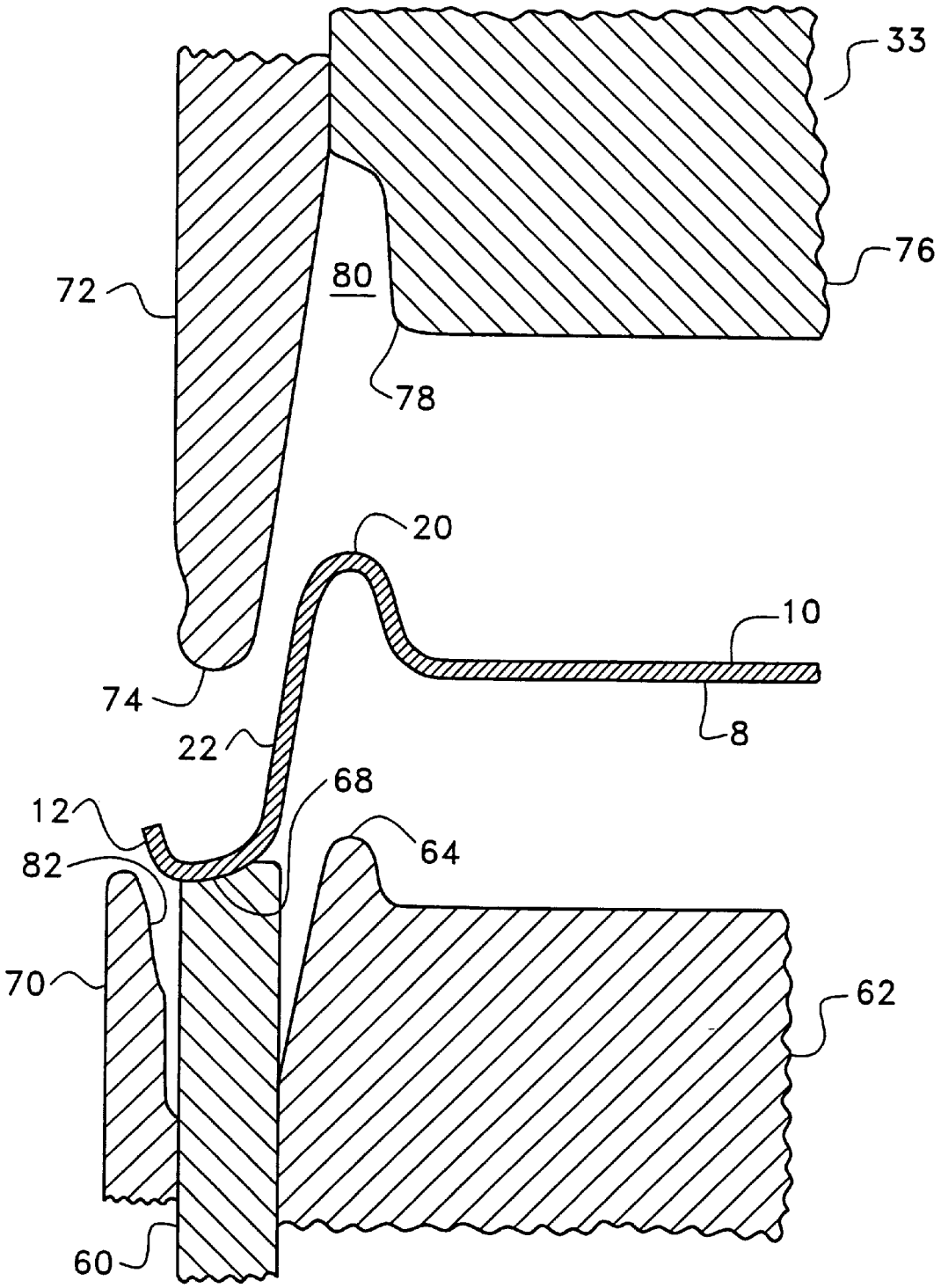
FIGS. 3(*a*) through (*d*) shown the steps associated with pre-curling the seaming panel, and with reducing the width and radius of curvature of the bead according to the current invention, in a second forming station.
Figure 3B:
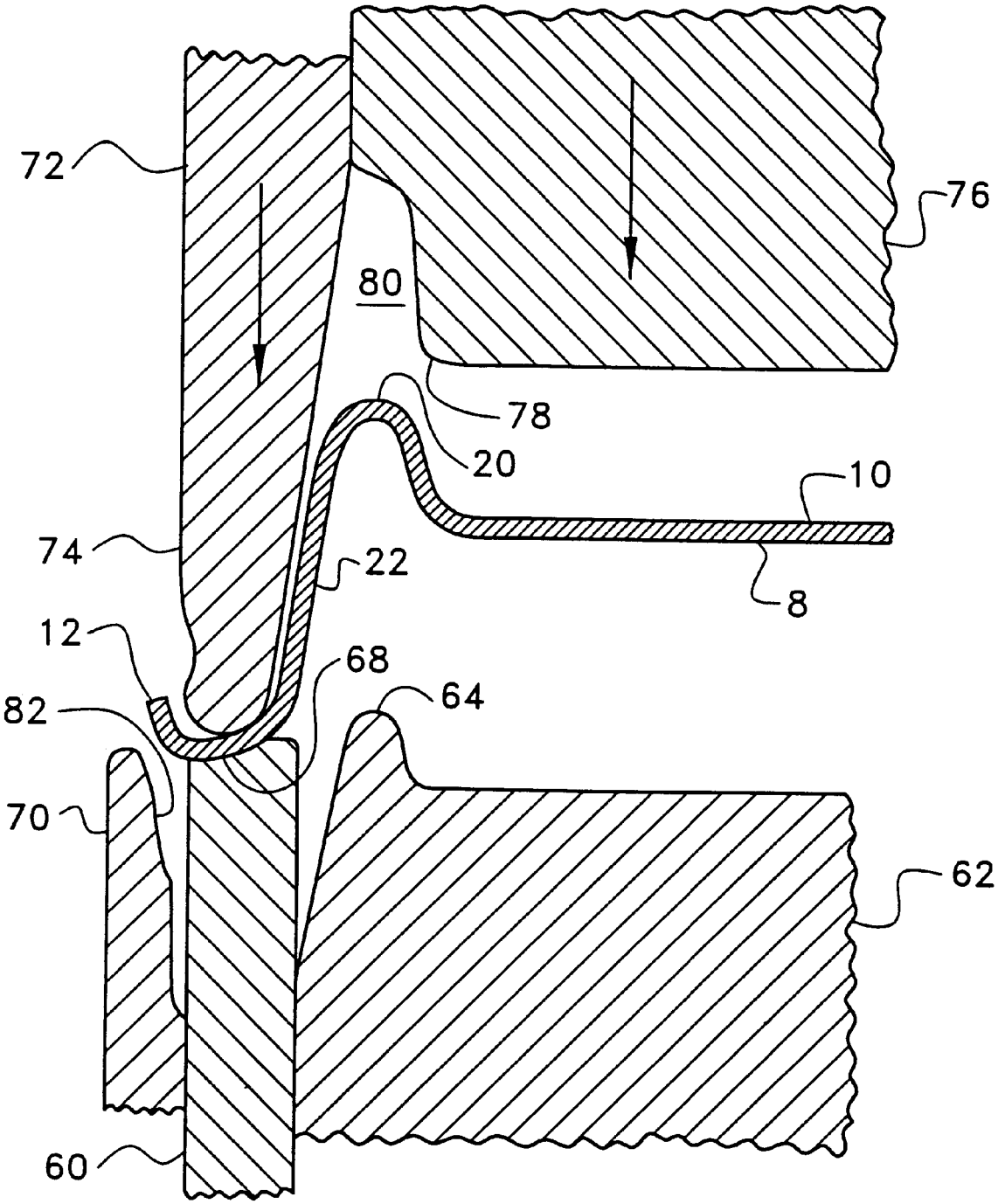
Figure 3C:
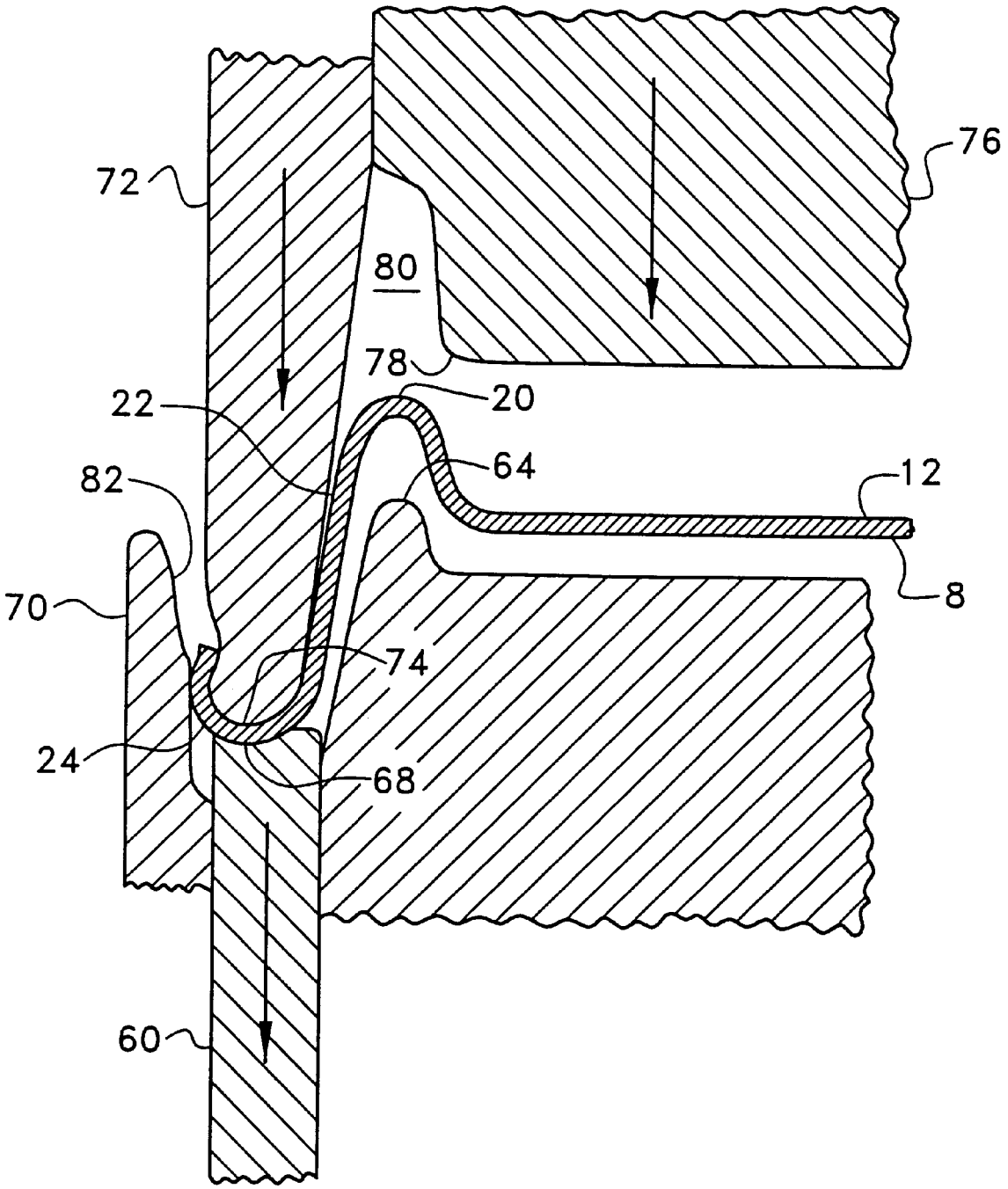
Figure 3D:
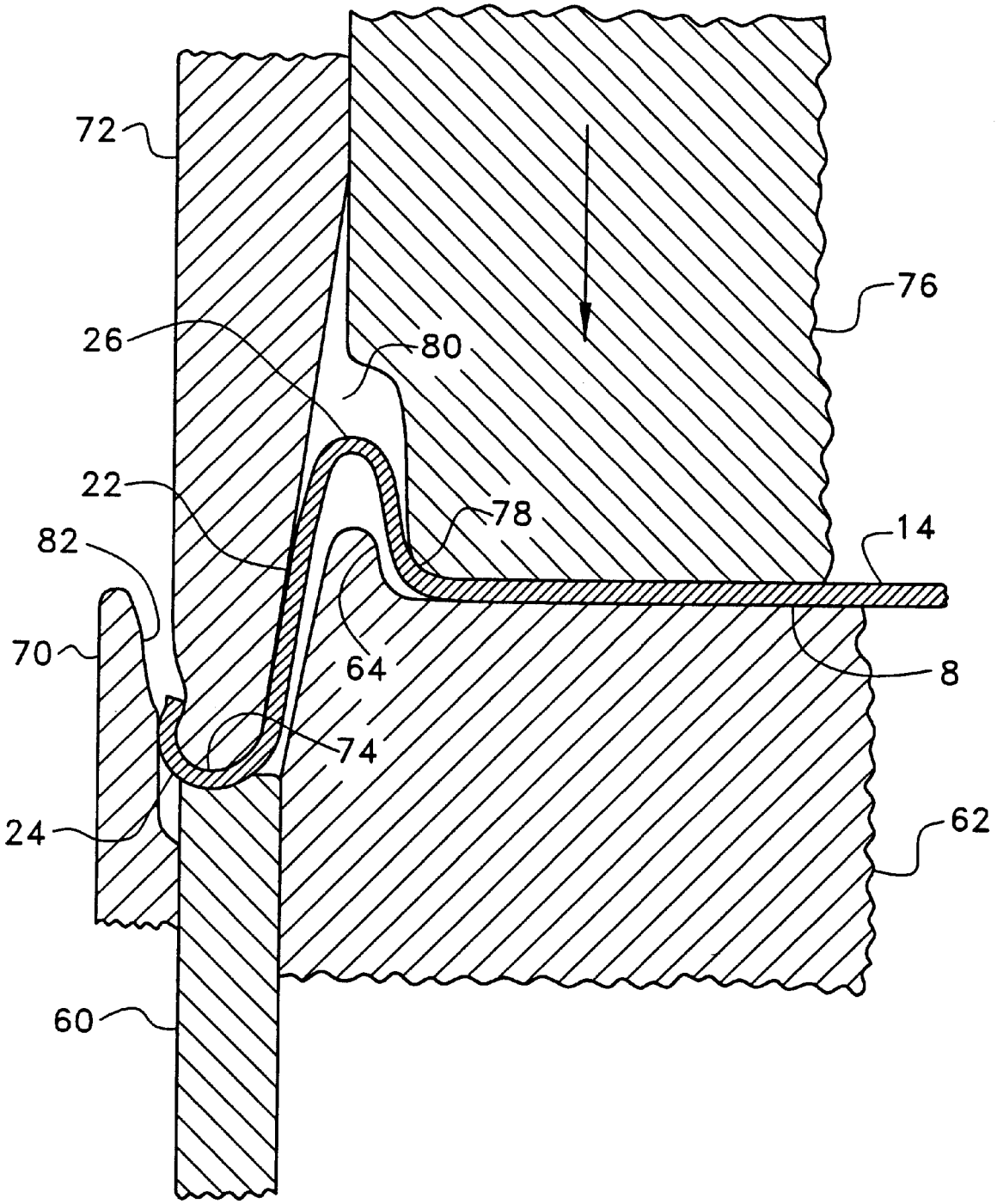

The successive stages of the geometry of a can end made according to the current invention are shown in FIGS. 1(*a*) through (*g*). The manufacturing begins by cutting a metal blank 2 having a circular periphery, shown in FIG. 1(*a*), from a sheet of metal, such as aluminum. The metal blank 2 is then drawn into a cup shaped blank 4, shown in FIG. 1(*b*). Next, the cup shaped blank 4 is formed into a can end blank 6 having a center panel 8 and a side panel 10, which includes a seaming panel 12 having an initial curl at its periphery, as shown in FIG. 1(*c*). The can end blank 6 is then formed into an initial, reformed can end 10 by reforming the side panel 10 to include an annular bead 20 and a chuck wall 22, in addition to the seaming panel 12, as shown in FIG. 1(*d*). As is conventional, the chuck wall 22 is preferably oriented at an angle of about 14° with respect to the vertical (i.e., the axis of the can body, which is perpendicular to the plane of the center panel). As is also conventional, the seaming panel 12 is then pre-curled, or partially curled, as shown in FIG. 1(*e*), to form an intermediate can end 12 having a pre-curl 24. The bead 20 is then reworked according to the current invention to reduce its width and radius of curvature, thereby forming a further intermediate can end 14 having a tightened bead 26, as shown in FIG. 1(*f*). Lastly, the pre-curl 24 is further curled into a final curl 28, as shown in FIG. 1(*g*), to form the finished can end 16. The finished can end 16 shown in FIG. 1(*g*) is then ready for sealing to a can body in a seaming operation, as is conventional.

The steps required to form the initial can end 10, which has an initial, relatively broad bead 20, according to the preferred embodiment of the invention, are shown in FIGS. 2(*a*) through (*e*). These operations are preferably performed in a multi-station conversion or transfer press. In a first forming station 31, a sheet of metal stock 1, such as aluminum, is clamped between an upper pressure pad 34 and a blank and draw die 36 and between a cut edge 30 and a stripper plate 32, as shown in FIG. 2(*a*). A punch core 40, which remains stationary during the forming operation and has a support surface 50, is position beneath the sheet 1. A cylindrical lower pressure pad 38, which has a support surface 48, encircles the punch core 40 and is movable relative to the punch core.

Next, the cut edge 30 and stripper plate 32 travel downward to sever the sheet 1 into the circular metal blank 2, as shown in FIG. 2(*b*). In addition, a die core 44 and cylindrical die core ring 42 are lowered into position above the metal blank 2. The die core ring 42, which has a radiused forming surface 46, encircles the die core 44 and is movable relative to the die core. The die core 44 has a recess formed in its outer edge so as to form an annular gap 52 with the die core ring 42.

As shown in FIG. 2(*c*), the die core 44 and die core ring 42 are then lowered so that the die core forming surface 46 draws the blank 2 out from between the blank and draw die 36 and upper pressure pad 34, and then down between the side surface of the blank and draw die and the die core ring 42, so as to form the cupped shaped blank 4 without wrinkling.

As shown in FIG. 2(*d*), the downward travel of the die core 44 and die core ring 42 continues until the forming surface 46 of the die core ring 42 presses the blank against the support surface 48 of the lower pressure pad 38, whereupon the lower pressure pad 38 begins to travel downward in tandem with the die core ring. The downward travel of the die core 44 continues in tandem with the die core ring 42 and lower pressure pad 38 until it presses the center panel 8 against the punch core 40, at which point the downward travel of the die core stops. However, the downward travel of the die core ring 42 and lower pressure pad 38 continues, thereby displacing the die core ring forming surface 46 below the punch core support surface 50. This relative motion between the die core ring 42 and punch core 40 draws the metal blank 4 around the forming surface 46 of the die core ring 42, thereby forming the side panel 10 having the initially curled seaming panel 12 at its periphery shown in FIG. 1(*c*). It should be noted that at this point—that is, as shown in FIG. 2(*d*)—the press is at its bottom dead center.

Although in the preferred embodiment, the die core ring 42 and lower pressure pad 38 move downward while the punch core 40 remains stationary, this step could also be practiced by holding the die core 42 and lower pressure pad 38 stationary and moving punch core 40 upward or by moving both away from each other—that is, of primary importance is the fact that relative motion takes place between the tools, rather than which tool moves.

As shown in FIG. 2(*e*), next the die core ring 42 and lower pressure pad 38 reverse direction and travel upward so that the lower pressure pad support surface 48 moves toward the punch core support surface 50. During this action, the seaming panel 12 remains clamped between the die core ring 42 and lower pressure pad 38, while the center panel 8 remains clamped between the die core 44 and punch core 40. As a result of the reversal in the direction of travel of the tooling, the can end blank is "reformed" by folding the metal in the side panel 10 upward into the recess 52 between the die core 44 and die core ring 42, thereby forming the initial, relatively broad bead 20. Although, in the preferred embodiment, the die core ring 42 and lower pressure pad 38 move upward while the punch core 40 remains stationary, this step could also be practiced by holding the die core 42 and lower pressure pad 38 stationary and moving die core 44 downward or by moving both toward each other—that is, of primary importance is the fact that relative motion takes place between the tools, rather than which tool moves.

Figure 5A:
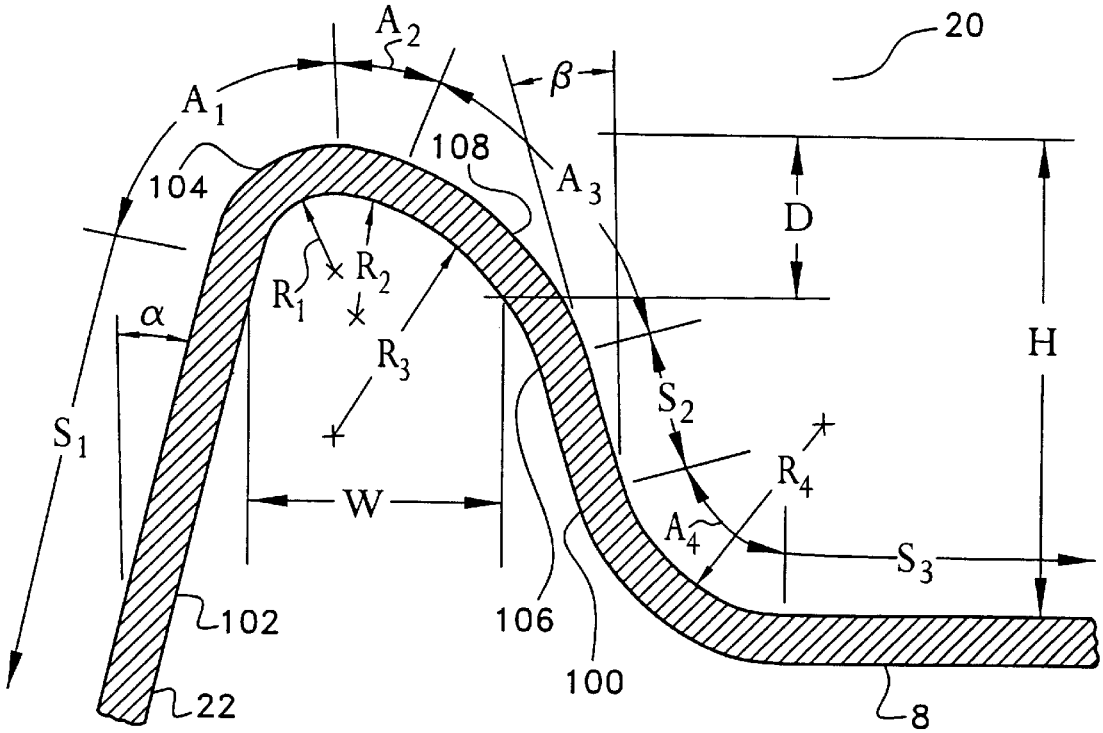
FIGS. 5(*a*) and (*b*) shown the bead before and after reworking according to the current invention.
Figure 5B:
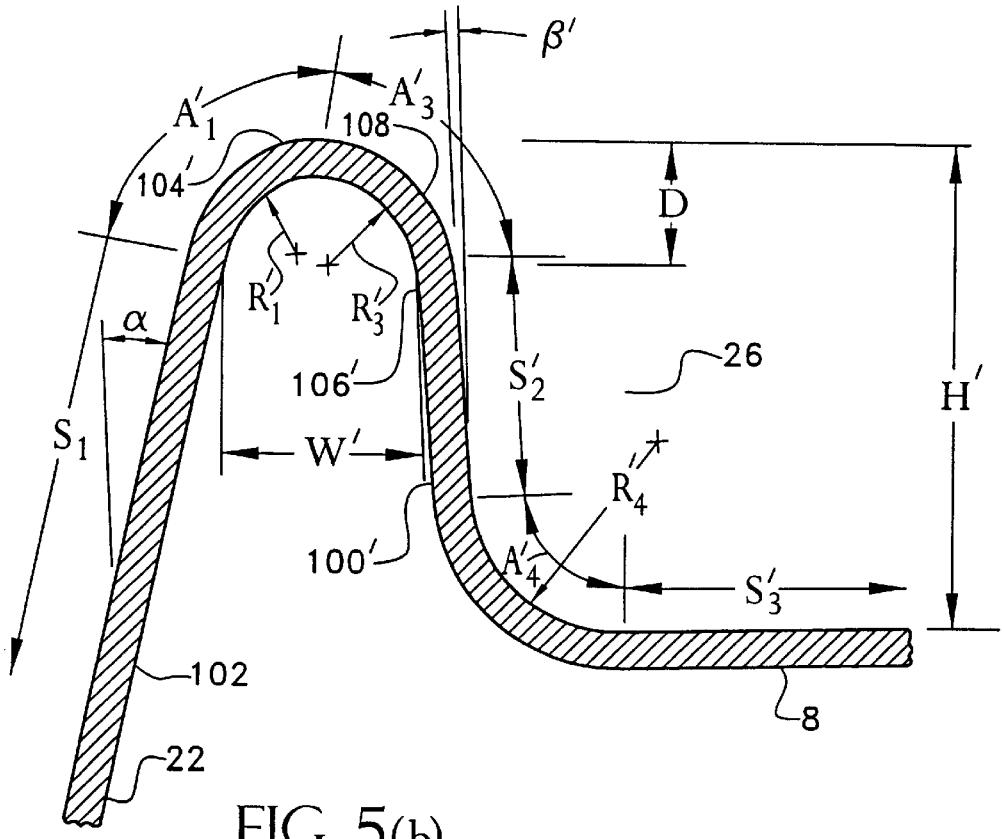

The initially formed bead 20 is shown in detail in FIG. 5(*a*). The bead 20 comprises inner and outer approximately conical walls 100 and 102, respectively. The walls 100 and 102 are connected by a circumferentially extending section 104 that is arcuate in cross-section and is formed by a number of arcuate segments, each of which has a different radius of curvature R. The width of the bead 20 is defined by the distance between the walls 100 and 102, which varies along the height of the bead. The inner and outer walls and the arcuate section each have interior and exterior surfaces that combine to form a concave interior bead surface 106 and a convex exterior bead surface 108. The distance between the interior and exterior surfaces 106 and 108 defines the thickness of the metal forming the bead 20.

As can be seen, the method of initially forming the bead 20 shown in FIG. 2(*e*) is performed without stamping or coining and without drawing or bending the metal around a tool, thereby minimizing the likelihood of cracking or excessive metal thinning. While these attributes are valuable, as previously discussed, the maximum potential benefit of the bead cannot be realized due to the limitations on the minimum size of the radii of curvature R and width W of the bead 20, shown in FIG. 5(*a*), achievable with this forming method.

Consequently, according to the current invention, the initially formed bead 20 is reworked to reduce both its width and radii of curvature. Like the initial forming of the bead, this reworking is accomplished without stamping or coining and without drawing or bending the metal forming the bead around a tool. Preferably, this is accomplished by transferring the intermediate can end 10 to a second forming station 33.

As shown in FIG. 3(*a*), in the second forming station 33, the seaming panel is first supported on a support surface 68 of a lower pressure pad 60. The lower pressure pad 60 is formed by ring that encircles a punch core 62. Further, the lower pressure pad 60 is encircled by a die curl ring 70, which has a forming surface 82. The lower pressure pad 60 is movable relative to the punch core 62 and die curl ring 70, both of which remain stationary during the reworking of the bead 20. The intermediate can end 10 is positioned so that the initial bead 20 is positioned above a nose 64 that projects upward from the punch core 62.

A die core 76 and cylindrical die core ring 72 are lowered into position above the intermediate can end 10. The die core 76 has a radiused forming surface 78 formed in its periphery. The die core ring 72, which has a radiused clamping surface 74, encircles the die core 76 and is movable relative to the die core. The die core 76 has a recess formed in its outer edge so as to form an annular gap 80 with the die core ring 72. The annular gap 80 is positioned directly above the initially formed bead 20.

As shown in FIG. 3(*b*), initially, the die core 76 and die core ring 72 are lowered in tandem so that the die core ring support surface 74 clamps the seaming panel 12 against the support surface 68 of the lower pressure pad 60. Thereafter, as shown in FIG. 3(*c*), the die core ring 72 and die core 76 continue to travel downward in tandem with the lower pressure pad 60. The travel of the die core ring 72 draws the seaming panel over the forming surface 82 in the die curl ring 70 so as to impart a further curl 24, sometimes referred to as a "pre-curl," to the seaming panel 12. As shown in FIG. 3(*c*) the die core ring 72 and lower pressure pad 60 are at the bottom of their stroke.

As shown in FIG. 3(*d*), after the die curl ring 72 and lower pressure pad 60 have completed their stroke, and while they continue to clamp the seaming panel 24, the die core 76 then moves downward relative to the die core ring 72 and lower pressure pad 60 until the die core presses the center panel 8 against the punch core 62. In so doing, the forming surface 78 of the die core reworks the bead 20 into its final geometry 26. According to one aspect of the current invention, the clamping of the seaming panel 24 during the reworking of the bead ensures that control over the location of the reworked bead can be precisely maintained. Although the reworking of the bead 20 is illustrated by moving the die core 76 downward, this step could also be practiced by moving the punch core 62 upward, or moving both tools toward each other—that is, of primary importance is the fact that relative motion takes place between the tools, rather than which tool moves.

Figure 4:
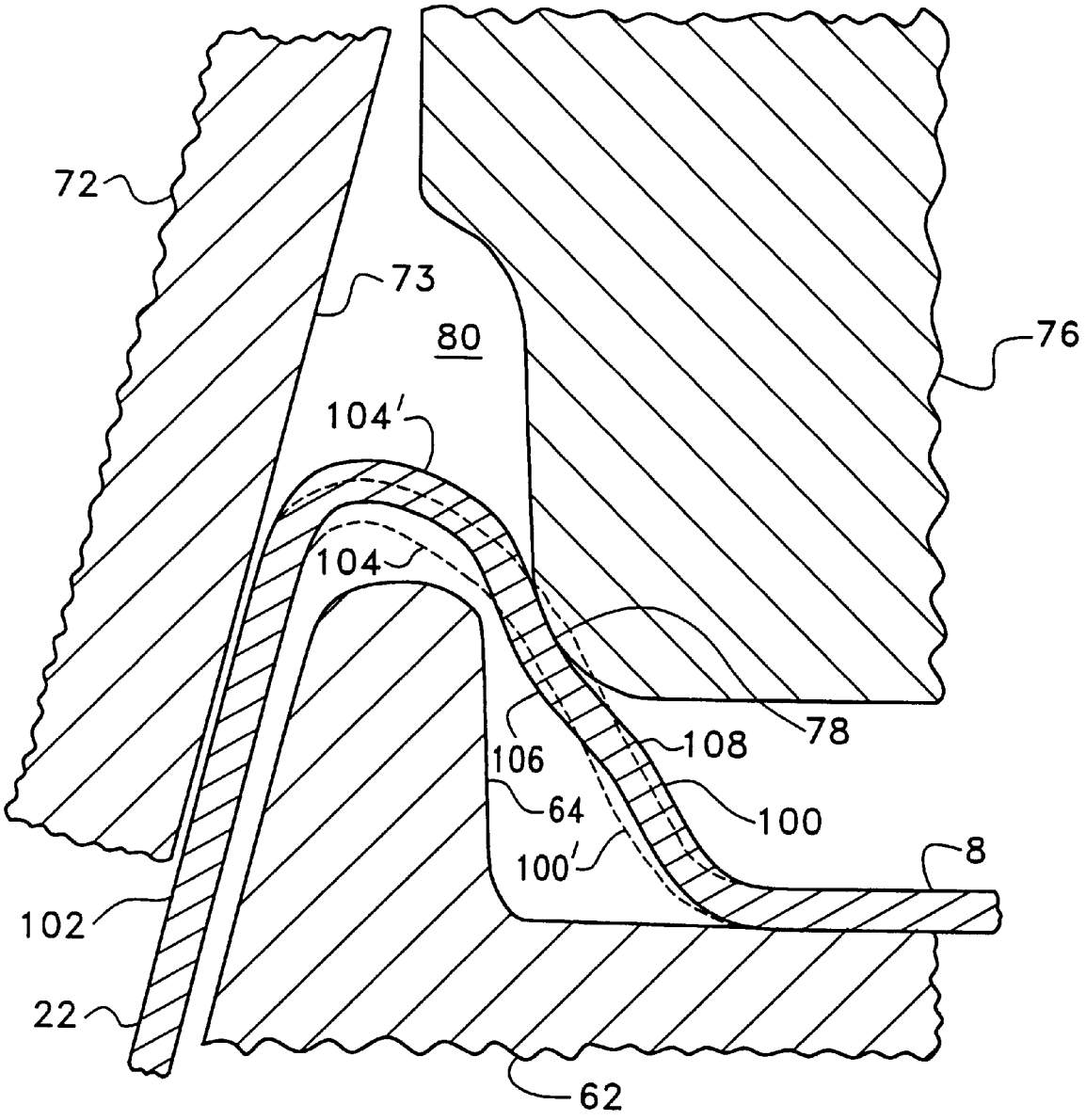
FIG. 4 is a detailed view of the free drawing of the bead according to the current invention, the conclusion of which is shown in FIG. 3(*d*).

The reworking of the initial bead 20 according to the current invention is shown in detail in FIG. 4. As the die core 76 moves downward, its forming surface 78 first contacts and is then dragged across the portion of the bead exterior surface 108 formed by the arcuate section 104 and the inner wall 100, thereby drawing the metal in these sections into the shape shown in FIG. 5(*b*).

Note that, as shown in FIG. 4, the portion of the interior surface 106 in the reworked section is not drawn or bent around the nose 64 of the punch core 62. Thus, herein the drawing process used to rework the bead discussed above is characterized as a "free drawing" process. In fact, most preferably, the interior surface 106 of the bead does not even contact the nose 64. Rather, the nose 64 merely serves as a locating device to ensure that the bead 20 is properly situated on the tooling. The inner surface 73 of the die core ring 72 merely provides a back stop for the outer wall 102 of the bead 20, thereby serving to restrain the outward deflection of the bead under the drawing action of the die core 76. Thus, the bead 20 is preferably reworked by using the die core 76 to draw only the inner wall 100; the die core ring 72 does not draw the outer wall. Moreover, as shown in FIG. 3(*d*), the punch core nose 64 is sized so that the clearance between the punch core nose and surfaces forming the annular gap 80 is greater than the thickness of the bead 26, and there is sufficient clearance between the punch core nose and the die core 76 and die core ring 72 to ensure that the bead 20 is not reworked by stamping the metal between the punch core nose and the die core/die core ring. Consequently, significant reductions in the width and radii of curvature of the bead can be achieved without splitting or excessively thinning the metal in the arcuate section at the top of the bead.

The preferred precise change in geometry as a result of reworking the bead 20 according to the current invention can be seen by comparing FIGS. 5(*a*) and (*b*). As previously discussed, the bead 20 is formed by inner and outer walls 100 and 102 connected by an arcuate section 104. As initially formed in the first station 31, the arcuate section 104 preferably consists of three arcuate segments $A_1$, $A_2$, and $A_3$, having radii of curvature $R_1$, $R_2$, and $R_3$, respectively. As a result of the reworking of the bead 20, as discussed above, segment $A_1$ is preferably altered so that its radius of curvature is reduced slightly, while segments $A_2$ and $A_3$ essentially become blended together into a single segment $A'_3$ having a radius of curvature less than that of either segments $A_2$ or $A_3$.

The outer wall 102 of the bead is initially formed by a straight section $S_1$ that is an extension of the chuck wall 22 and that is oriented at an angle $\alpha$ with respect to the vertical that is preferably about 14°, as previously discussed. Preferably, the geometry of the outer wall 102 is not affected by the reworking. Initially, the inner wall 100 of the bead comprises a conical section $S_2$ that is oriented at an angle $\beta$ with respect to the vertical that is preferably about 5°, although a larger angle is show in FIG. 5(*a*) for emphasis. An arcuate section $A_4$ connects the conical section $S_2$ to a planar section $S_3$ that forms the center panel 8. As a result of the reworking of the bead, the angle $\beta$ is decreased to about 1° or less so that, preferably, the inner wall 100' extends approximately vertically. The arcuate section $A_4$ of the inner wall 100 has a radius of curvature $R_4$ that is reduced as a result of the reworking of the bead.

As a result of the reworking, the height of the bead H is increased and the width of the bead is decreased. Although the width varies long the height of the bead, one frame of reference for bead width W can be established at a distance D from the top of the bead, with D being equal to about three times the thickness of the metal forming the bead.

The table below shows the values for the bead geometry before and after reworking according to one embodiment of the invention:

| | Before Reworking | After Reworking |
|---|---|---|
| $R_1$ | 0.010 inch (0.25 mm) | 0.008 inch (0.20 mm) |
| $R_2$ | 0.030 inch (0.76 mm) | — |
| $R_3$ | 0.016 inch (0.4 mm) | 0.015 inch (0.35 mm) |
| $R_4$ | 0.020 inch (0.5 mm) | 0.018 inch (0.45 mm) |
| $\alpha$ | 14° | 14° |
| $\beta$ | 5° | 1° |
| W | 0.040 inch (1.0 mm) | 0.030 inch (0.75 mm) |
| H | 0.092 inch (2.37 mm) | 0.095 inch (2.41 mm) |

Figure 6:
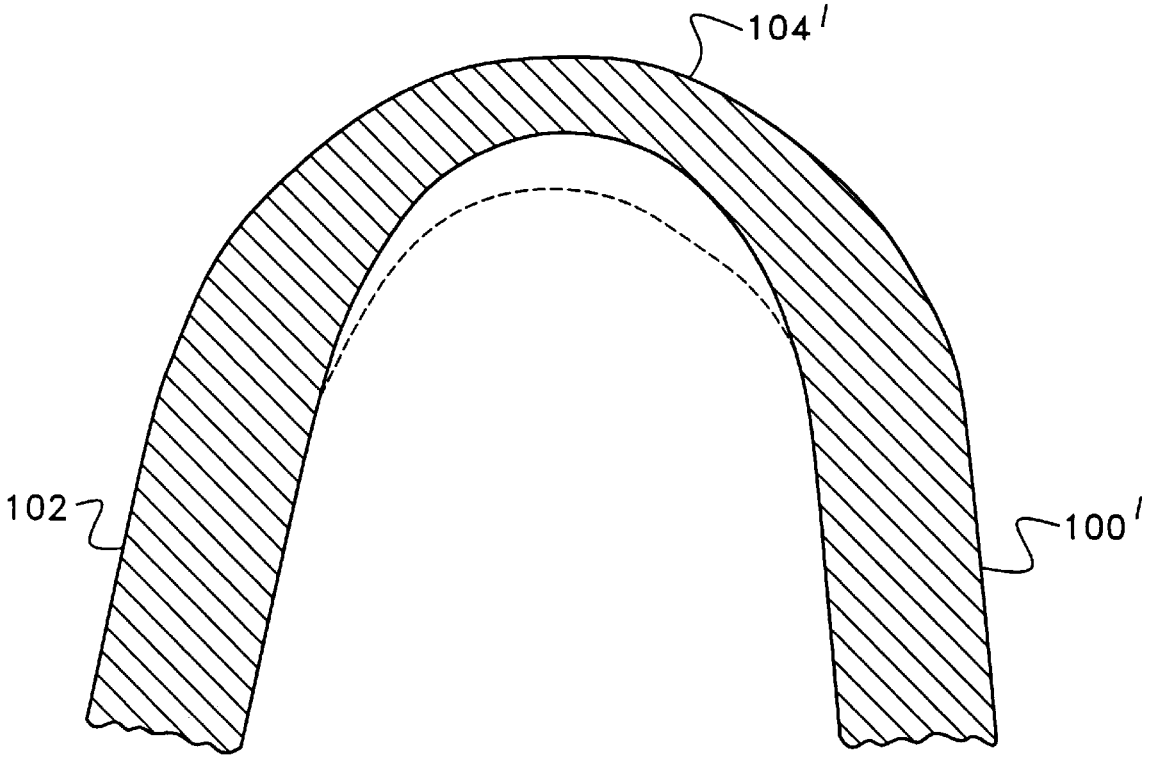
FIG. 6 illustrates the thinning of the metal in the top of the bead that occurs using previously known methods, shown by the solid line, compared to that associated with the current invention, shown by the dashed line.

The thickness of the bead is preferably about 0.01 inch (0.25 mm) and, preferably, throughout most of the bead, remains essentially unchanged as a result of the reworking. In the critical arcuate section 104 of the bead, the thickness is preferably reduced no more than about 9%. This is an improvement over prior techniques, such as drawing or bending the bead metal around a tool, in which the thickness of the metal in the arcuate section may be reduced by about 15% or more. FIG. 6 is an illustration, exaggerated for effect, showing the bead metal thinning of the current invention, shown by the dashed line, compared to what would be obtained if one attempted to use prior techniques, such as stamping/coining or drawing/bending around a tool, shown by the solid line, to rework the bead to obtain the geometry made possible using the current invention.

Figure 7A:
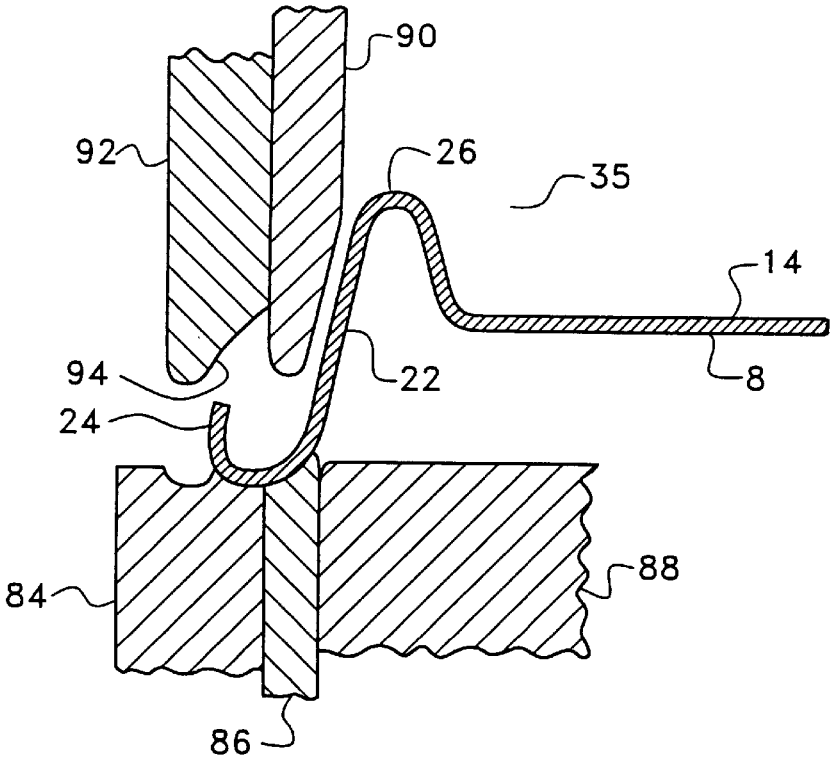
FIGS. 7(*a*) and (*b*) shown the final curling of the seaming panel in a third forming station.
Figure 7B:
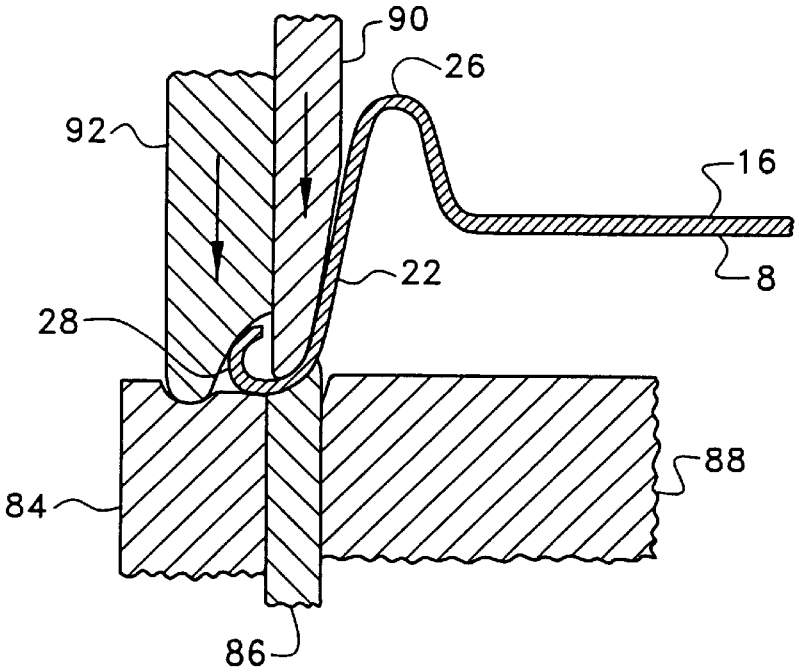

After reworking, the novel bead 26 according to the current invention is preferably subjected to a conventional final curling operation by transferring it to a third forming station 35, as shown in FIGS. 7(*a*) and (*b*). As shown in FIG. 7(*a*), the pre-curled seaming panel 24 is supported by support surfaces formed in a lower pressure pad 86, which encircles a punch core 88, and a die curling ring 84, which encircles the lower pressure pad. A curling punch 92, which has a forming surface 94, is position above the seaming panel 24 and encircles a die core ring 90. As shown in FIG. 7(*b*), the die core ring 90 is lowered so as to clamp the seaming panel 24 against the lower pressure pad 86, and the die curl ring 92 is lowered so that its forming surface 94 further curls the seaming panel.

The initial forming station 31, the pre-curling/bead reworking station 33, and the final curling station 35 are preferably located within a single, multi-station press, such as that available from the Minster Machine Company of Minster, Ohio. Tooling for the initial forming and final curling stations is currently available from Redicon Corporation of Jackson Township, Ohio. Preferably, the initial forming station 31 uses two levels within the press while the pre-curl/bead reworking and final curling stations 33 and 35 are located at the second level, with endless belts being used for transport between the stations, as disclosed in U.S. Pat. No. 4,903,521 (Bulso), assigned to Redicon Corporation, hereby incorporated by reference in its entirety.

According to the current invention, a narrow, tightly radiused annular bead is formed in a can end by initially "reforming" the can end so as to fold the side panel into a relatively broad bead and then reworking the inner wall of this bead by drawing a tool along the inner wall of the bead in a "free drawing" process. Both the initial "reforming" and the reworking operations are performed without drawing or bending the bead metal around a tool. As a result, a narrow, tightly radiused annular anti-peaking bead is formed in a can end without cracking or excessive thinning of the metal. Although less preferred, the initial forming operation could also be performed using the stamping/coining method or drawing/bending around a tool method discussed in the patents incorporated by reference in the second and third paragraphs of the Background of the Invention section.

The present invention may be embodied in other specific forms without departing from the spirit or essential attributes thereof and, accordingly, reference should be made to the appended claims, rather than to the foregoing specification, as indicating the scope of the invention.

What is claimed:

1. A method of forming a can end, comprising the steps of:

a) forming a metal blank having a periphery and a center panel;

b) forming an annular bead in said metal blank, said annular bead defined by radially displaced and circumferentially extending inner and outer walls joined by an arcuate section, said inner and outer walls defining a width of said bead therebetween, said annular bead having an exterior surface and an interior surface, said exterior and interior surfaces defining therebetween a thickness of said metal forming said bead, said bead outer wall having a length and inclined at an angle;

c) clamping a portion of said metal blank disposed between said periphery and said annular bead using a ring, said ring having an inner wall inclined at an angle approximately equal to said bead outer wall angle, said ring inner wall disposed adjacent substantially the entirety of said length of said bead outer wall so as to restrain deflection of said bead outerwall in the radially outward direction; and d) reducing said width of said annular bead by drawing a tool across at least a portion of said exterior surface of said bead without drawing said interior surface of said bead around a tool surface, thereby free drawing said bead, said free drawing of said bead being performed while simultaneously maintaining said clamping of said portion of said metal blank by said ring and while simultaneously maintaining said ring inner wall adjacent said bead outer wall so as to restrain radially outward deflection of said bead outer wall over the entirely of said length of said bead outer wall during said free drawing of said bead.

2. The method according to claim 1, wherein the step of forming said annular bead is performed at a first forming station, and wherein the steps of clamping said metal blank and reducing said width of said annular bead is performed at a second forming station, and further comprising the step of transferring said metal blank having said annular bead formed in step (b) to a second forming station prior to performing step (c).

3. The method according to claim 2, further comprising the steps of:

a) forming a side panel portion of said metal blank adjacent said periphery of said metal blank prior to forming said annular bead; and b) curling at least a portion of said side panel portion, said curling step being performed at said second forming station.

4. The method according to claim 1, wherein the step of drawing said tool across said portion of said exterior surface of said bead is performed without bending said interior surface of said bead around a tool surface.

5. The method according to claim 1, further comprising the step of inserting an annular member into said bead prior to the step of reducing the width of said bead, and wherein the step of reducing said width of said annular bead is performed while said annular member remains in said bead but without causing said bead to be pressed against said annular member.

6. The method according to claim 5, wherein said annular member comprises a nose of a punch core.

7. The method according to claim 1, wherein said portion of said exterior surface across which said tool is drawn comprises at least said inner wall of said annular bead.

8. The method according to claim 7, wherein said inner wall of said annular bead is disposed at an angle with respect to the vertical direction, and wherein the step of reducing said width of said bead comprises reducing said angle.

9. The method according to claim 1, wherein said arcuate section of said annular bead has a radius of curvature, and wherein the step of reducing said width of said annular bead comprises reducing said radius of curvature.

10. The method according to claim 1, wherein the step of reducing said width of said annular bead by said free drawing thereof reduces said bead metal thickness by no more than about 9%.

11. The method according to claim 1, further comprising the step of forming a side panel portion of said metal blank adjacent said periphery of said metal blank prior to forming said annular bead.

12. The method according to claim 11, wherein the step of forming said annular bead comprises drawing and then folding said side panel.

13. The method according to claim 1, further comprising the step of forming a side panel portion of said metal blank adjacent said periphery of said metal blank prior to forming said annular bead, and wherein the step of clamping said metal blank comprises clamping said side panel portion thereof.

14. The method according to claim 13, wherein said ring clamping said portion of said metal blank is a first ring, and wherein the step of clamping said side panel comprises the step of clamping said side panel portion between said first ring and a second ring.

15. The method according to claim 14, wherein the step of drawing said tool across said portion of said exterior surface comprises moving said tool relative to said first and second rings.

16. The method according to claim 13, further comprising the step of curling at least a portion of said side panel, and wherein the step of clamping at least said portion of said side panel comprises clamping said curled portion of said side panel.

17. The method according to claim 1, wherein said tool is formed by a die core.

18. A method of forming a can end, comprising the steps of:

a) forming a circular metal blank;

b) drawing said metal blank into a can end blank having a side panel and a center panel by (i) supporting a first portion of said metal blank against a surface of a first tool, (ii) pressing a surface of a second tool against a second portion of said metal blank, and (iii) moving at least one of said tool surfaces away from the other of said tool surfaces so as to draw said metal blank across at least one of said tool surfaces;

c) moving at least one of said first and second tool surfaces toward the other of said tool surfaces so as to fold at least a portion of said side panel into an annular bead, said annular bead defined by radially displaced and circumferentially extending inner and outer walls joined by an arcuate section, said inner and outer walls defining a width of said bead therebetween, said annular bead having an exterior surface and an interior surface, said bead outer wall having a length and inclined at an angle;

d) clamping said side panel portion of said metal blank between third and fourth tools, said third tool forming a surface inclined at an angle approximately equal to said bead outer wall angle, said third tool surface disposed adjacent substantially the entirety of said length of said bead outer wall so as to restrain deflection of said bead outerwall in the radially outward direction; and e) reducing said width of said annular bead by drawing a surface of a fifth tool across at least a portion of said exterior surface of said bead without drawing said interior surface of said bead around any tool surface, thereby free drawing said bead, said drawing of said bead by said fifth tool being performed while simultaneously maintaining said clamping of said side panel by said third and fourth tools and while simultaneously maintaining said third tool surface adjacent said bead outer wall so as to restrain radially outward deflection of said bead outer wall over the entirely of said length of said bead outer wall during said free drawing of said bead.

19. A press for forming a can end, comprising:

a) means for forming a metal blank having a periphery and a center panel;

b) means for forming an annular bead in said metal blank, said annular bead defined by radially displaced and circumferentially extending inner and outer walls joined by an arcuate section, said inner and outer walls defining a width of said bead therebetween, said annular bead having an exterior surface and an interior surface, said exterior and interior surfaces defining therebetween a thickness of said metal forming said bead, said bead outer wall having a length and inclined at an angle;

c) a clamp for clamping a portion of said metal blank disposed between said periphery and said annular bead, a portion of said clamp forming a surface inclined at an angle approximately equal to said bead outer wall angle, said clamp surface position so as to be disposed adjacent substantially the entirety of said length of said bead outer wall so as to restrain deflection of said bead outerwall in the radially outward direction; and d) means for reducing said width of said annular bead while simultaneously clamping said portion of said metal blank and while simultaneously maintaining said clamp surface adjacent said bead outer wall so as to restrain radially outward deflection of said bead outerwall over the entirety of said length of said bead outer wall, said width reducing means comprising (i) a tool having a forming surface thereon, and (ii) means for drawing said tool forming surface across at least a portion of said exterior surface of said bead without drawing said interior surface of said bead around a tool surface.

20. The press according to claim 19, wherein said means for reducing said width of said annular bead comprises a punch core, said punch core having a circumferentially extending nose sized to enter said annular bead.

21. The press according to claim 20, wherein said nose is sized to enter said annular bead without contacting said interior surface thereof prior to said width of said annular bead being reduced.

22. The press according to claim 21, wherein said nose is sized to enter said annular bead without contacting said interior surface thereof after said width of said annular bead has been reduced.

23. The press according to claim 19, wherein said means for drawing said tool forming surface across said portion of said exterior surface comprises means for drawing said tool forming surface across at least said inner wall of said annular bead.

24. The press according to claim 19, wherein said inner wall of said annular bead is oriented at an angle with respect to the axial direction, and wherein said means for reducing said width of said bead comprises means for reducing said angle.

25. The press according to claim 19, wherein said arcuate section of said annular bead has a radius of curvature, and wherein said means for reducing said width of said annular bead comprises means for reducing said radius of curvature.

26. The press according to claim 19, wherein said means for reducing said width of said annular bead comprises means for reducing said bead metal thickness by no more than 9% during said reduction of said width of said annular bead.

27. The press according to claim 19, further comprising means for forming a side panel in a portion of said metal blank adjacent said periphery of said metal blank prior to forming said annular bead.

28. The press according to claim 27, wherein said means for forming said annular bead comprises means for drawing and then folding said side panel.

29. The press according to claim 27, wherein said clamp clamps at least a portion of said side panel.

30. The press according to claim 19, wherein said means for forming an annular bead is located at a first forming station, and wherein said clamp and said means for reducing said width of said annular bead are located at a second forming station.

31. The press according to claim 30, wherein said second forming station further comprises a curling die for curling said periphery of said metal blank.

32. The press according to claim 31, wherein said clamp clamps said curled periphery of said metal blank.

33. The press according to claim 30, wherein said means for forming a metal blank having a periphery and a center panel forms a portion of said first forming station.

* * * * *

UNITED STATES PATENT AND TRADEMARK OFFICE

CERTIFICATE OF CORRECTION

PATENT NO. : 6,089,072
DATED : July 18, 2000
INVENTOR(S) : Brian Fields

It is certified that error appears in the above-identified patent and that said Letters Patent is hereby corrected as shown below:

Title page,
Item [56], U.S. PATENT DOCUMENTS, delete "4,587,825 5/1986 Buslo, Jr. et al." and insert -- 4,587,825 5/1986 Bulso, Jr. et al. --;
delete "4,587,826 5/1986 Buslo, Jr. et al." and insert -- 4,587,826 5/1986 Bulso, Jr. et al. --;
delete "4,716,755 1/1988 Buslo, Jr. et al." and insert -- 4,716,755 1/1988 Bulso, Jr. et al. --;
delete "4,808,052 2/1989 Buslo, Jr. et al." and insert -- 4,808,052 2/1989 Bulso, Jr. et al. --;
delete "4,809,861 3/1989 Wilsinson et al." and insert -- 4,809,861 3/1989 Wilkinson et al. --;
FOREIGN PATENT DOCUMENTS, delete "92 11 788 2/1993 Germany" and insert -- G 92 11 788.0 2/1993 Germany --;
delete "2 067 159 7/1981 United Kingdom" and insert -- 2 067 159 A 7/1981 United Kingdom --;
delete "2 288 759 11/1995 United Kingdom" and insert -- 2 288 759 B 11/1995 United Kingdom --;
OTHER PUBLICATIONS, delete "Moran, P., "Double Seam Formation", *Beverage Can 'Mini Seam' Double Seam Manual*, published at least as early as Apr. 1, 1995, pp. 7-8." and insert -- Moran, P., "Double Seam Formation", *Beverage Can 'Mini Seams' Double Seam Manual*, published at least as early as Apr. 1, 1995, pp. 7-8. --;

Column 2,
Lines 9-10, delete "reduce its the width" and insert -- reduce its width --;
Line 17, delete "In another approached," and insert -- In another approach, --;

Column 3,
Lines 7-8, delete "while simultaneously the clamping of the portion of the metal blank." and insert -- while simultaneously clamping the portion of the metal blank. --;
Lines 40, 47 and 53, delete "shown" and insert -- show --;

Column 4,
Line 29, delete "is position" and insert -- is positioned --;

UNITED STATES PATENT AND TRADEMARK OFFICE

CERTIFICATE OF CORRECTION

PATENT NO. : 6,089,072
DATED : July 18, 2000
INVENTOR(S) : Brian Fields

It is certified that error appears in the above-identified patent and that said Letters Patent is hereby corrected as shown below:

Column 5,
Line 64, delete “by ring” and insert -- by a ring --;

Column 7,
Line 41, delete “varies long” and insert -- varies along --;

Column 8,
Line 17, delete “is position” and insert -- is positioned --;

Column 9,
Line 21, delete “entirely of” and insert -- entirety of --;

Column 11,
Line 1, delete “entirely of” and insert -- entirety of --.

Signed and Sealed this

Twenty-first Day of October, 2003

JAMES E. ROGAN
*Director of the United States Patent and Trademark Office*